US009593865B2

(12) United States Patent
Noman et al.

(10) Patent No.: US 9,593,865 B2
(45) Date of Patent: Mar. 14, 2017

(54) FINGER AIR BAFFLE FOR HIGH EFFICIENCY FURNACE

(71) Applicant: Lennox Industries Inc., Richardson, TX (US)

(72) Inventors: Shiblee S. M. Noman, Carrollton, TX (US); John W. Whitesitt, Carrollton, TX (US)

(73) Assignee: LENNOX INDUSTRIES INC., Richardson, TX (US)

( * ) Notice: Subject to any disclaimer, the term of this patent is extended or adjusted under 35 U.S.C. 154(b) by 688 days.

(21) Appl. No.: 13/705,861

(22) Filed: Dec. 5, 2012

(65) Prior Publication Data

US 2014/0150775 A1 Jun. 5, 2014

(51) Int. Cl.

| | |
|---|---|
| ***F24H 9/18*** | (2006.01) |
| ***F24H 9/00*** | (2006.01) |
| ***B21D 5/00*** | (2006.01) |
| ***B21D 51/46*** | (2006.01) |
| ***B21D 51/48*** | (2006.01) |
| ***F24H 3/08*** | (2006.01) |
| ***F23D 14/04*** | (2006.01) |

(52) U.S. Cl.

CPC ..... *F24H 9/0063* (2013.01); *B21D 5/00* (2013.01); *B21D 51/46* (2013.01); *B21D 51/48* (2013.01); *F23D 14/045* (2013.01); *F24H 3/087* (2013.01); *Y10T 29/49826* (2015.01)

(58) Field of Classification Search

CPC ..... F23D 14/70
USPC ..... 126/99 D, 99 R, 110 R; 165/157
See application file for complete search history.

(56) References Cited

U.S. PATENT DOCUMENTS

| | | | | |
|---|---|---|---|---|
| 2,796,238 | A * | 6/1957 | Sjoden | 165/55 |
| 6,851,469 | B2 * | 2/2005 | Sears et al. | 165/170 |
| 2003/0127087 | A1 * | 7/2003 | Hill | F24H 3/105 126/99 R |
| 2008/0236792 | A1 * | 10/2008 | Mast et al. | 165/80.4 |

* cited by examiner

*Primary Examiner* — Avinash Savani

(57) ABSTRACT

One aspect of this disclosure provides a finger baffle for a heating furnace. This embodiment includes an elongated support plate having a length, and at least one finger baffle extending outwardly and in a vertically oriented direction from the elongated support plate. The at least one finger baffle has a width that extends along the length of the elongated support plate. The finger baffle may be employed in a high-efficiency gas furnace.

13 Claims, 6 Drawing Sheets

FINGER AIR BAFFLE FOR HIGH EFFICIENCY FURNACE

TECHNICAL FIELD

This application is directed, in general, to heating, ventilation and air conditioning (HVAC) systems and, more specifically, to a high efficiency furnace having a finger air baffle.

BACKGROUND

A high-efficiency furnace typically employs several heat exchangers to warm an air stream passing through the furnace. A high-efficiency furnace is one where approximately 90% of the energy put into the furnace is converted into heat for the purposes of heating the targeted space. These high-efficiency furnaces include "clamshell" or individual panel halves formed by stamping mirror images of the combustion chambers into corresponding metal sheets and coupling them together. Often high-efficiency furnaces comprise a primary heating chamber that includes the clamshell heat exchangers and a secondary heat exchanger/condenser. The air passes through the secondary heat exchanger/condenser from a blower or fan and then passes through the primary heat exchanger. High-efficiency furnaces are also characterized by high operating temperatures. However, cracking problems in the clamshell heat exchanger panels can occur when the temperatures within the heat exchanger consistently exceed about 950 degrees. When such cracks appear, their occurrence is considered a failure of the system.

SUMMARY

One aspect of this disclosure provides a finger baffle for a heating furnace. This embodiment comprises an elongated support plate having a length, and at least one finger baffle extending outwardly and in a vertically oriented direction from the elongated support plate. The at least one finger baffle has a width that extends along the length of the elongated support plate.

Another aspect provides a high-efficiency gas furnace. In one embodiment the furnace comprises a housing, a primary heating zone located within the housing that includes spaced apart primary heating chambers, wherein each of the primary heating chambers has a pre-determined hot spot associated therewith and located adjacent an outlet end of each of the primary heating chambers. This embodiment further comprises a secondary heat exchanger and condenser zone located downstream of an air flow path from the primary heating zone and the finger baffle as described above. A blower is located within the housing proximate and downstream of the air flow path from the secondary heat exchanger and condenser zone.

A method of fabricating a finger baffle for a heating furnace is also provided. One method embodiment comprises forming an elongated body having a length from sheet metal, forming spaced apart finger baffles from the elongated body, and bending the finger baffles such each of the finger baffles extend outwardly and in a vertically oriented direction from the elongated support plate, each of the finger baffles having a width that extends along a length of the elongated body.

In another aspect, a method of fabricating a high-efficiency gas furnace is provided. This method embodiment comprises providing a housing, placing a primary heating zone within the housing that includes spaced apart primary heating chambers, wherein each of the primary heating chambers has a pre-determined hot spot associated therewith and located adjacent an outlet end of each of the primary heating chambers. The method further comprises placing a secondary heat exchanger and condenser zone within the housing, located downstream of an air flow path from the primary heating zone, and attaching a finger baffle to a frame of the primary heating zone and adjacent the outlet end of the primary heating chambers. The finger baffle comprises an elongated support plate having a length and spaced apart finger baffles extending outwardly and in a vertically oriented direction from the elongated support plate, each of the finger baffles having a width that extends along the elongated support plate and a length that extends from the elongated support plate to the pre-determined hot spot. A blower is placed within the housing proximate and downstream of the air flow path from the secondary heat exchanger and condenser zone.

BRIEF DESCRIPTION

Reference is now made to the following descriptions taken in conjunction with the accompanying drawings, in which.

DETAILED DESCRIPTION

Figure 1:
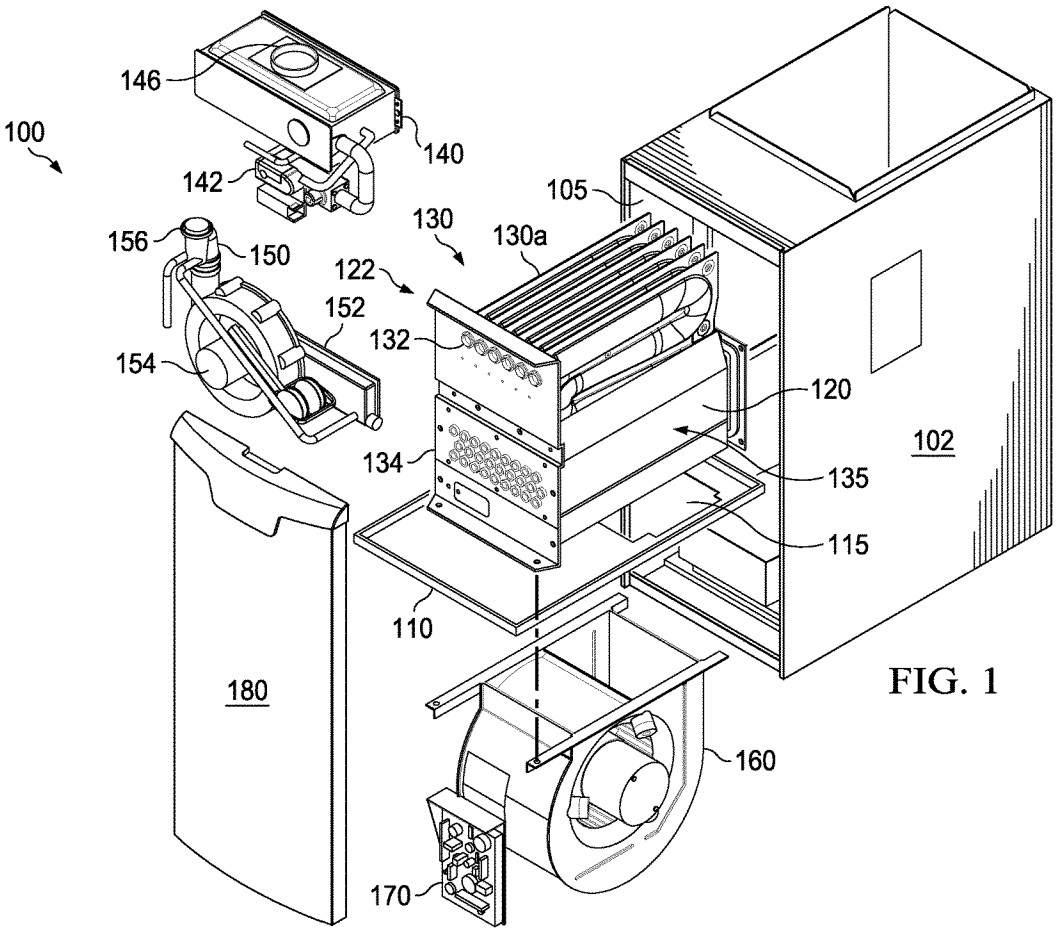
FIG. 1 illustrates an exploded isometric view of a portion of one embodiment of a furnace within which the finger baffle may be employed.

Described herein are various embodiments of a vertically oriented finger baffle that may be employed in a high-efficiency furnace adjacent an outlet end of a heat exchange chamber panel. As used herein and in the claims, a vertical orientation includes those configurations where the individual finger baffles deviate from a true vertical orientation of 90 degrees with respect to a support plate of the finger baffle by about −45 degrees to about +15 degrees. The finger baffle is designed to be placed within a primary heating zone of a furnace and between heating chambers proximate an outlet end thereof, where it guides the air to a hot spot located proximate the outlet end of the heating chamber. The purpose of finger baffle, as provided herein, is to reduce the temperature at the hot spot associated with each heating chamber without detrimentally increasing cubic feet per minute (CFM) airflow of the furnace.

In present day furnaces, expensive material is used to construct heat exchangers due to the high operating temperatures. Due to the benefits associated with the finger air baffle as presented herein, manufactures can use lower cost EDDS materials, thereby reducing manufacturing costs while maintaining the operational life of the high-efficiency furnace. In certain embodiment, the finger baffle successfully reduces the temperature of the heating chamber to 937° F. The embodiments of the finger baffle as presented herein do not detrimentally increase or decrease the main blower performance, thus the CFM/watt remains the same as found in present conventional units. Additionally, it reduces the flue temperature, which increases the furnace's efficiency.

In general, the various embodiments of the finger baffle provides airflow to a hot spot by providing a surface of sufficient width along which airflow travels, thereby effectively guiding the airflow to the desired area on the heating chamber. Without being limited by any theory of operation, it is believed that the airflow guidance is based on the coanda effect, wherein the fluid airflow is attracted to the flat surface of the finger baffles. The guidance of the airflow causes the air to be directed more toward hot spots adjacent the finger baffles, thereby reducing the temperature of the heating chambers and keeping their operating temperature within design parameters, which prevents premature stress and cracking in the area of the hot spot. The lengths of the fingers of the baffle, the widths of the finger baffles, the material out of which the finger baffle is constructed, and the location and orientation of the finger baffle relative to the heat exchanger panels potentially affect the performance of the finger baffle.

Though the finger baffle as presented herein could be used in any furnace chamber, it provides particular benefits to high-efficiency furnaces where 90% of the fuel burned is converted directly into heat. The benefits arise from the fact that these high-efficiency furnaces reach higher operational temperatures, which causes the heating chambers to prematurely stress and crack at the above-mentioned hot spots. As stated above, the finger baffles help guide the airflow more directly to these hot spots, which reduces stress and premature cracking.

FIG. 1 is an exploded isometric view of a portion of one embodiment of a high-efficiency furnace 100 within which embodiments of the finger baffle as presented herein may be employed. The furnace includes a housing 102 having a front opening 105 within which a mounting shelf 110 is located. The mounting shelf 110 has an opening 115 therein and supports a heat exchanger assembly 120 over the opening 115. The illustrated embodiment of the heat exchanger assembly 120 has a primary heating zone 130 that includes a row of six heating chambers (one referenced as 130*a*) coupled to an inlet panel 122. Alternative embodiments of the heat exchanger assembly 120 have more or fewer heating chambers 130*a* coupled to the inlet panel 122 in one or more rows. In the illustrated embodiment, the heating chambers 130*a* form the primary heating zone 130 and are generally serpentine and have two approximately 180° folds such that the heating chambers 130*a* cross over the opening 115 at least three times, terminating in inlets 132 and outlets 134 that are generally mutually coplanar and oriented toward the opening 105 of the housing 100. The heat exchanger assembly 120 may further include a secondary heat exchanger zone 135 that is a heat exchanger/condenser.

A burner assembly 140 contains a thermostatically-controlled solenoid valve 142, a manifold 144 leading from the valve 142 and across the burner assembly 150, one or more gas orifices (not shown) coupled to the manifold 144 and one or more burners (not shown) corresponding to and located proximate the gas orifices. The illustrated embodiment of the burner assembly 140 has a row of six burners. Alternative embodiments of the burner assembly 140 have more or fewer burners arranged in one or more rows. A flue 146 allows undesired gases (e.g., unburned fuel) to be vented from the burner assembly 140. In an assembled configuration, the burner assembly 140 is located proximate the heat exchanger assembly 120 such that the burners thereof at least approximately align with the inlets 132.

A draft inducer assembly 150 contains a manifold 152, a draft inducing exhaust fan 154 having an inlet coupled to the manifold 152 and a flue 156 coupled to an outlet of the exhaust fan 154. In an assembled configuration, the draft inducer assembly 150 is located proximate the heat exchanger assembly 120, such that the manifold 152 thereof at least approximately aligns with the outlets 134 and the flue 156 at least approximately aligns with the flue 146 of the burner assembly 140.

A blower 160 is suspended from the shelf 110 such that an outlet (not referenced) thereof approximately aligns with the opening 115. An electronic controller 170 is located proximate the blower 160 and, in the illustrated embodiment, controls the blower, the valve 142 and the exhaust fan 154 to cause the furnace to provide heat. A cover 180 may be placed over the front opening 105 of the housing 100.

In the illustrated embodiment, the controller 170 turns on the exhaust fan to initiate a draft in the heat exchangers (including the primary heating zone 130) and purge potentially harmful unburned gases or gaseous combustion products. Then the controller 170 opens the valve 142 to admit gas to the manifold 144 and the one or more gas orifices, whereupon the gas begins to mix with air to form primary combustion air. Then the controller 170 activates an igniter (not shown in FIG. 1) to attempt to ignite the primary combustion air. If the output of a thermocouple indicates that the primary combustion air has not ignited within a predetermined period of time, the controller 170 then closes the valve 142 and waits until attempting to start again. If the output of a thermocouple indicates that the primary combustion air has ignited within the predetermined period of time, the controller 170 then activates the blower, which forces air upward through the opening 115 and the heat exchanger assembly 120. As it passes over the surfaces of the heat exchangers, the air is warmed, whereupon it may be delivered or distributed as needed to provide heating.

Figure 2:
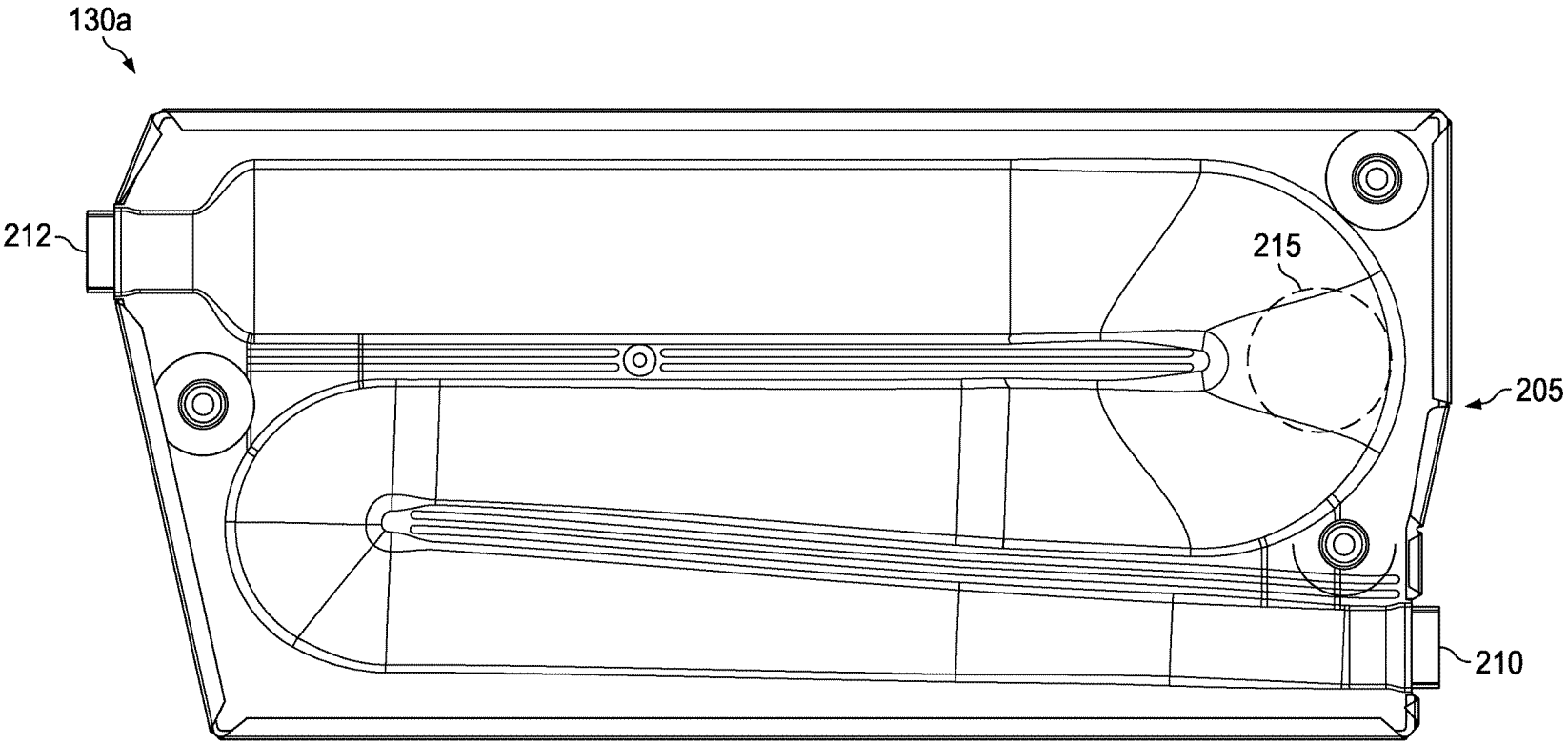
FIG. 2 illustrates a high-efficiency heating chamber used in the furnace of FIG. 1.

FIG. 2 illustrates an embodiment of one of the high-efficiency heating chambers 130*a*, as referenced above. The heating chamber 130*a* may be a clamshell design wherein mirrored halves are joined together in a conventional manner to form a heating chamber panel. Typically, the two mirrored halves are joined by one half overlapping the edge of the other and being crimped together or joined in another conventional manner. The heating chamber 130*a* has a backend 205, which is where an outlet end 210 (exhaust end) is located. Ignited gas enters the heating chamber 130*a* at an inlet end 212 and traverses the chamber pathway and exits the heating chamber 130*a* at outlet end 210. Due to the high-efficiency characteristics of the heating chamber 130*a*, a hot spot 215 can develop during the operation of the furnace, and which overtime, can fatigue the metal and cause it to crack. The location of the hot spot 215 can be determined by obtaining readings from a thermocouple placed on the heating chamber 130*a* Typically, in conventional designs, to extend the life of the heating chamber 130*a*, manufacturers have fabricated the heating chambers from a more expensive sheet material to prevent premature cracking and failure of the heating chamber 130*a*. However, when used with the embodiments of the finger baffle as described herein, a lower cost material, commercially known as EDDS (extra deep drawing steel), can be used, thereby reducing manufacturing costs, while maintaining a high quality operational life of the heat chamber 130*a*.

Figure 3:
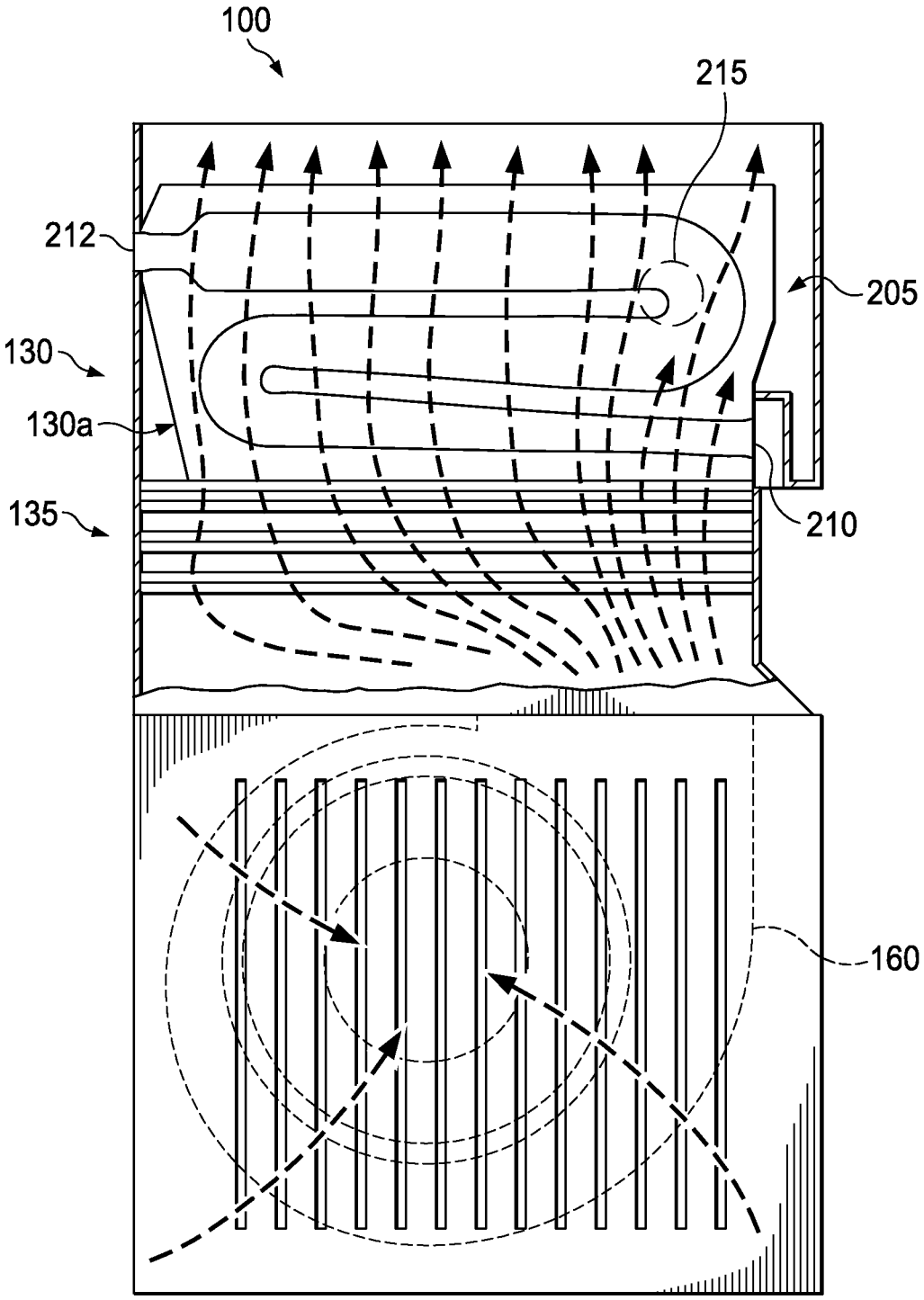
FIG. 3 illustrates a CFD analysis showing the airflow path lines through a primary heating chamber of the furnace of FIG. 1.

FIG. 3 is a CFD analysis showing the path lines of the airflow through the primary heating zone 130. As seen from this analysis, the airflow across the backend 205 of the heating chamber 130*a*, which is where the outlet end 210 is located, separates at the backbend of the heating chamber 130*a*. This diversion in the airflow path causes the hot spot 215 to develop during operation. However, as explained below, the presence of the finger baffle disrupts this normal airflow pattern and guides more of the air to the hot spot, thereby providing additional heat dissipation, which in turn, reduces the stress and premature cracking associated with its operation and extends the life of the heating chamber 130*a*.

Figure 4A:
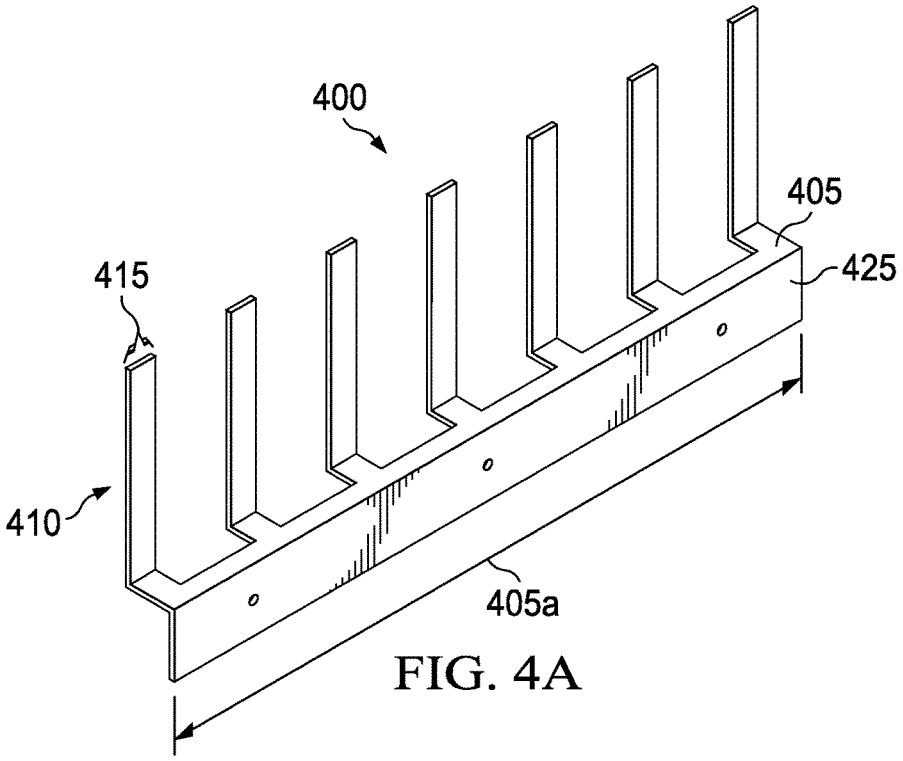
FIGS. 4A-4C illustrate examples of some of the embodiments of the finger baffle and the orientation of the individual finger baffles.
Figure 4B:
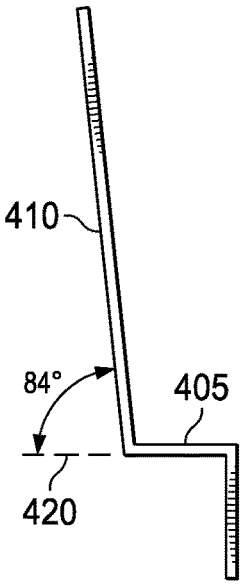
Figure 4C:
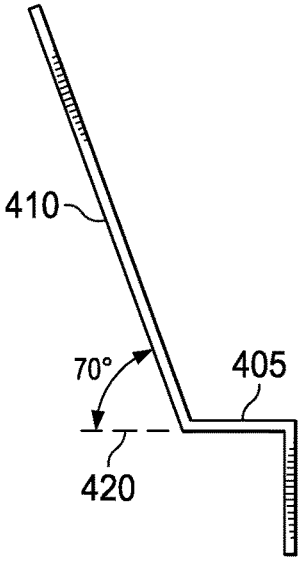

FIGS. 4A-4C are various embodiments of a finger baffle device 400, as presented herein. FIG. 4A is a perspective view of one embodiment of the finger baffle device 400. This embodiment is comprised of an elongated support plate 405 having a length 405*a* and individual finger baffles 410 extending outwardly and in a vertically oriented direction from the elongated support plate 405 when the support plate 405 is positioned in a horizontal orientation. The individual finger baffles 410 have a width 415 that extends along the length 405*a of* the elongated support plate 405, and in one embodiment, a length that is designed to extend to the upper limits of the hot spot when positioned adjacent a heating chamber 130*a*, as shown in FIG. 2. However, in other embodiments, the length may be either shorter or longer than the length just stated above, provided that the length is sufficient to guide the airflow to the hot spot without reducing the CFM performance of the furnace 100 (FIG. 1) to a degree that is outside of design parameters. In one example, the width may be about 1 inch and the length of the finger may be about 2 inches. It should be noted that these dimensions are given as examples only and the present disclosure is not limited to any particular dimension, because they are scaled to the dimensions of the furnace in which they are employed.

Though seven finger baffles 410 are shown, it should be understood that other embodiments may provide fewer (at least one) or more than what is shown. The number of individual finger baffles 410 that will be present can depend on the number of heating chambers 130*a* present in the furnace in which the finger baffle device 400 will be used. For example, in one aspect, the finger baffle device 400 may be designed such that an individual finger baffle 410 is be placed adjacent each hot spot of each heating chamber 130*a*, however, an individual finger baffle 410 need not be associated with each heating chamber 130*a*, although in a preferred embodiment, such will be the case. The finger baffles 410 are located along the edge of the elongated support plate 405 that is closest to the inlet end 212 (FIG. 2) of the heat chamber 130*a*.

In one aspect of this disclosure, the individual finger baffles 410 may be individually attached to the elongated support plate 405. However, in another embodiment, they may be integrally formed from the elongated support plate 405, as shown in FIG. 4A. In the embodiment illustrated in FIG. 4A, the individual finger baffles 410 are vertically oriented at an angle of 90 degrees as measured from the elongated support plate 405. However, in other embodiments, the vertical orientation of the individual finger baffles 410 ranges from about 70 degrees as taken from reference line 420 to about 90 degrees as taken from the elongated support plate 405, as shown in FIGS. 4A-4C.

With the present disclosure, it has been found that these ranges provide improved results over angles less than 70 degrees as taken from the reference line 420. Tests were conducted where the individual finger baffles were positioned at degrees, 84 degrees, and 90 degrees adjacent each heating chamber 130*a* to determine what affect they would have on the maximum operating temperature of the furnace. These results were compared with an instance where no baffle was used. The results are illustrated in Table 1, as follows:

TABLE I

| Angle Position | Maximum Furnace Temperature |
|---|---|
| No Baffle Present | 994° |
| 70° | 975° |
| 84° | 981° |
| 90° | 920° |

As seen from the foregoing data, the presence of the finger baffle made a significant improvement in the operating temperature of the furnace, with the 90 degree position showing the best improvement. Though there is a slight variation in the results of 70 degrees and 84 degrees, it should be noted that when angle positions of less than 45 degrees were tested, the maximum operating temperature of the furnace increased above the temperatures noted for the finger baffle configurations.

In another aspect, the finger baffle 400 further includes an angled connecting plate 425 integrally formed with and extending downwardly from the elongated support plate 405. In one embodiment, the connecting plate 425 extends downwardly from said elongated support plate at a 90 degree angle and extends along the length of the elongated support plate 405. When present, the connecting plate 425 can be used to connect to the frame of the primary heating zone 130 (FIG. 1). However, when the connecting plate 425 is not present, the finger baffle device 400 can be attached (e.g. by screw or blot) to the support frame of the primary heating zone by using the elongated support plate 405.

Figure 5:
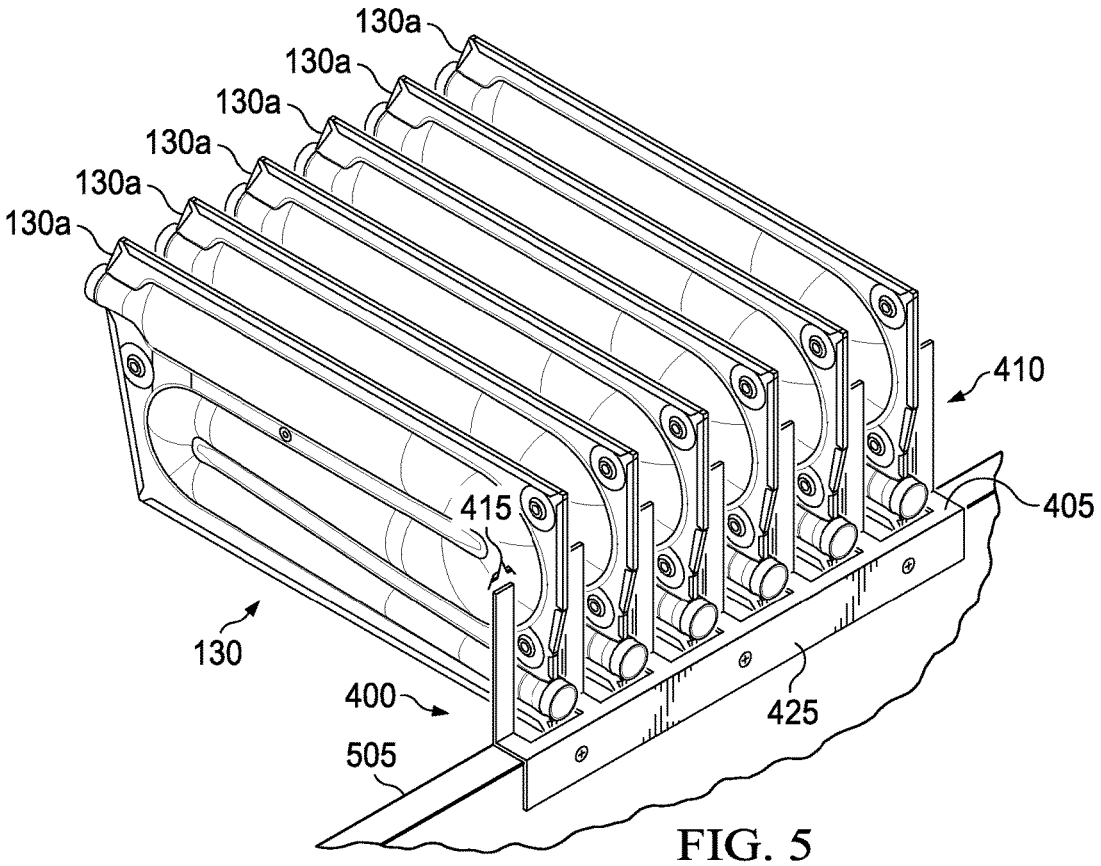
FIG. 5 illustrates an embodiment of the finger baffle positioned in a primary heating zone of the furnace of FIG. 1 and with respect to individual heating chambers that comprise the primary heating zone.

FIG. 5 illustrates an embodiment of the finger baffle 400 attached to a frame 425 of at the back end or outlet end of the primary heat zone 130. As seen in this embodiment. The individual finger baffles 410 are located between each of the heating chambers 130*a*, but as discussed above the finger baffle 400 is not limited to this configuration. The individual finger baffles 410 are positioned such that they extend into the airflow adjacent a predetermined hot spot of each of the heating chambers 130*a*.

Figure 6:
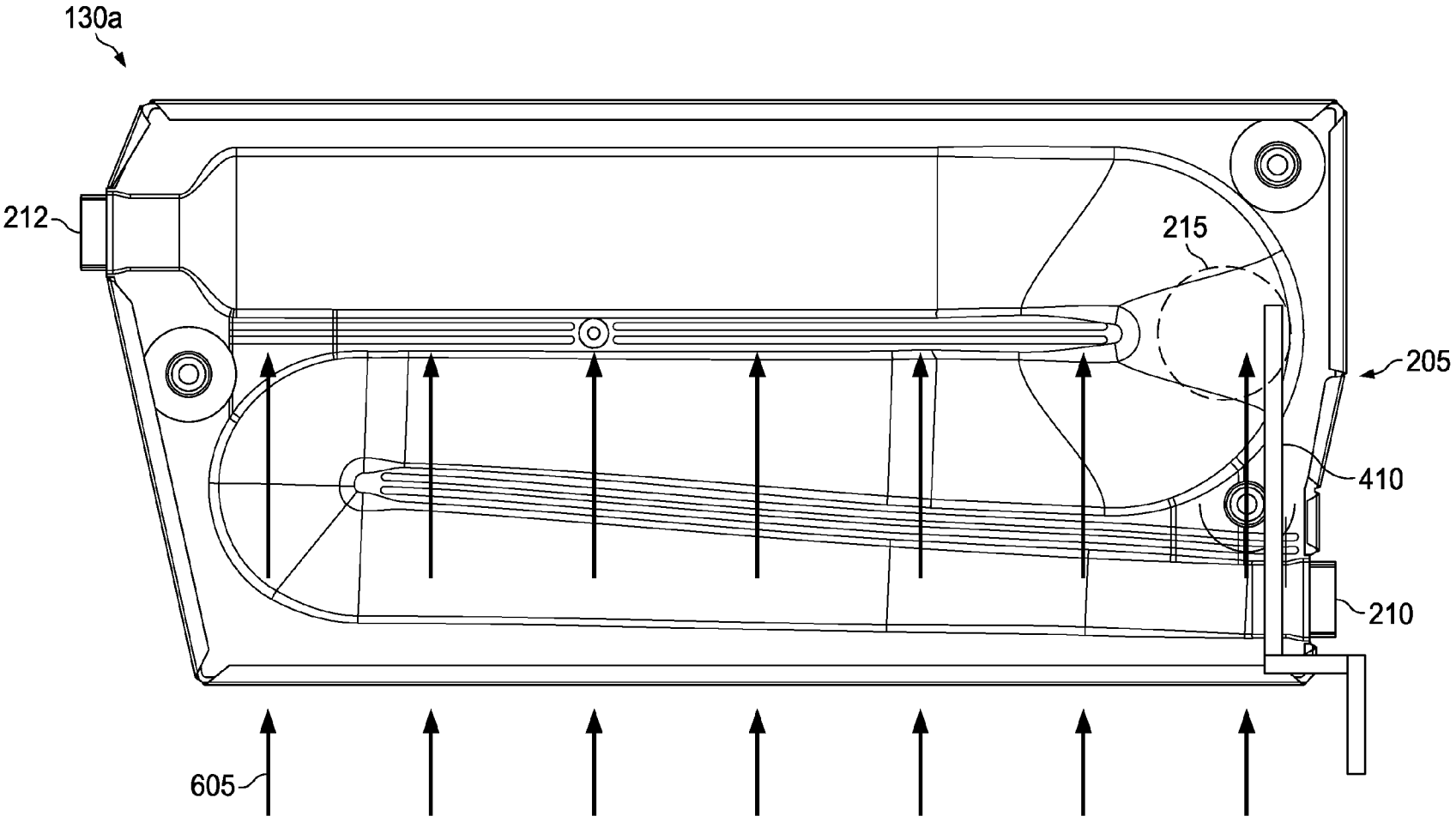
FIG. 6 illustrates the effect of using an embodiment of the finger baffle on an airflow path across the heating chamber.

FIG. 6 illustrates a heating chamber 130*a* with an airflow path 605 flowing across the heating chamber 130*a*. The finger baffle 410 is positioned adjacent the hot spot 215 and helps to guide the airflow that occurs at the backend 205 of the heating chamber 130*a* to the hot spot 215. This is in contrast to the airflow path as shown in FIG. 3 where the airflow diverts from the hot spot 215. Thus, due to the presence of the finger baffle 410, more air reaches the hot spot 215, thereby providing additional heat transmission, which in turn, reduces buildup of heat that can cause premature cracking in the hot spot 215.

With reference to FIGS. 1-6, in one embodiment of a methodology of fabrication, the finger baffle 400 may be fabricated by forming the elongated body 405 having a length 405*a* from sheet metal, such as an EDDS material. The elongated body 405 may be cut from stock sheet metal and the individual spaced apart finger baffles 410 may be formed form from that same piece of sheet metal by cutting or stamping the individual finger baffles 410 from the sheet metal. Each of the finger baffles 410 has a width that extends along a length of the elongated body. After the sheet metal is formed in the manner stated above, conventional techniques can be used to bend the finger baffles 410 such that each of the finger baffles 410 extend outwardly and in a vertically oriented direction from the elongated support plate 405 when positioned in a horizontal orientation. In various embodiments, the vertically orientation of each of the finger baffles 410 can range from about 70 degrees away from the elongated support plate 405 to about 90 degrees with respect to the elongated support plate 405, as illustrated in FIGS. 4A-4C, and in one preferred embodiment at an angle of 90 degrees with respect to the elongated support plate 405.

In another aspect, the method of forming the elongated body 405 may include cutting enough sheet material such that an angled connecting plate 425 can be formed by bending the elongated body 405 in a downward direction from the elongated support plate 405, and preferably at a 90 degree angle from the elongated body 405.

In another embodiment, there is provided a method of fabricating a high efficiency gas furnace 100. This embodiment comprises providing a housing 102, placing a primary heating zone 130 within the housing 100 that includes spaced apart heating chambers 130*a*, wherein each of the heating chambers 130*a* has a pre-determined hot spot 215 associated therewith and located adjacent an outlet end 210 of each of the heating chambers 130*a*. The method further comprises placing a secondary heat exchanger and condenser zone 135 within the housing 102, located downstream of an air flow path from the primary heating zone 130. The finger baffle 400 as described above is then positioned with the primary heating zone 130 and adjacent the outlet end 210 of the primary heating zone 130. A blower 160 is also positioned within the housing 102 proximate and downstream of the airflow path 605 from the secondary heat exchanger and condenser zone 135.

Those skilled in the art to which this application relates will appreciate that other and further additions, deletions, substitutions and modifications may be made to the described embodiments.

What is claimed is:

1. A finger baffle for a heating furnace, comprising: an elongated support plate having a length; and at least one finger baffle extending outwardly and in a vertically oriented direction from said elongated support plate, said at least one finger baffle having a width that extends along said length of said elongated support plate and a length that extends from said elongated support plate to a pre-determined hot spot of a heating chamber, wherein the finger baffle is placed within a primary heating zone of the heating furnace to guide air to the hot spot located proximate an outlet end of the heating chamber.

2. The finger baffle of claim 1, wherein said at least one finger baffle is integrally formed from said elongated support plate.

3. The finger baffle of claim 1, wherein said at least one finger baffle is a first of a multiple of finger baffles wherein each of said finger baffles extend outwardly and in a vertically oriented direction from said elongated support plate.

4. The finger baffle of claim 1, wherein said vertically orientation of said at least one finger baffle ranges from about 70 degrees in a direction away from a horizontal plane of said elongated support plate to about 84 degrees in a direction away from a horizontal plane of said elongated support plate.

5. The finger baffle of claim 4, wherein said at least one finger baffle is oriented at an angle of 90 degrees with respect to said elongated support plate.

6. The finger baffle of claim 1, further including an angled connecting plate integrally formed with and extending downwardly from said elongated support plate.

7. The finger baffle of claim 6, wherein said connecting plate extends downwardly from said elongated support plate at a 90 degree angle and extends along said length of said elongated support plate.

8. A high efficiency gas furnace, comprising: a housing;

a primary heating zone located within said housing that includes spaced apart primary heating chambers, wherein each of said primary heating chambers has a pre-determined hot spot associated therewith and located adjacent an outlet end of each of said primary heating chambers;

a secondary heat exchanger and condenser zone located downstream of an air flow path from said primary heating zone; a finger baffle, comprising:

an elongated support plate having a length; and spaced apart finger baffles extending outwardly and in a vertically oriented direction from said elongated support plate, each of said finger baffles having a width that extends along said elongated support plate and a length that extends from said elongated support plate to said pre-determined hot spot; and a blower located within said housing proximate and downstream of said air flow path from said secondary heat exchanger and condenser zone, wherein the finger baffle is placed within a primary heating zone of the heating furnace to guide air to the hot spot located proximate an outlet end of the heating chamber.

9. The high efficiency gas furnace of claim 8, wherein a spacing of said finger baffles corresponds to a spacing of said primary heating chambers such that each one of said finger baffles is located adjacent a pre-determined hot spot of a different one of said primary heating zones.

10. The high efficiency gas furnace of claim 8, wherein said vertically orientation of each of said finger baffles ranges from about 70 degrees away from said elongated support plate to about 90 degrees with respect to said elongated support plate.

11. The high efficiency gas furnace of claim 10, wherein each of said finger baffles is oriented at an angle of 90 degrees with respect to said elongated support plate.

12. The high efficiency gas furnace of claim 8, further including an angled connecting plate integrally formed with and extending downwardly from said elongated support plate.

13. The high efficiency gas furnace of claim 12, wherein said connecting plate extends downwardly from said elongated support plate at a 90 degree angle and extends along said length of said elongated support plate.

* * * * *